United States Patent [19]

Anderson et al.

[11] Patent Number: 4,970,754

[45] Date of Patent: Nov. 20, 1990

[54] CARPET TACK STRIP WITH URETHANE BASE

[76] Inventors: Martin L. Anderson, Maple Lake, Minn.; Benny R. Wood, 187 Tate Estates Rd., Rome, Ga. 30161

[21] Appl. No.: 392,402

[22] Filed: Aug. 11, 1989

[51] Int. Cl.[5] ..... A47G 27/04

[52] U.S. Cl. ..... 16/16

[58] Field of Search ..... 16/16

[56] References Cited

U.S. PATENT DOCUMENTS

| | | | |
|---|---|---|---|
| 3,673,633 | 7/1972 | Frebraro | 16/16 |
| 3,828,391 | 8/1974 | Sutton et al. | 16/16 |
| 3,858,269 | 1/1975 | Sutton et al. | 16/16 |
| 4,309,805 | 1/1982 | Jacobson | 16/16 |

*Primary Examiner*—Richard K. Seidel
*Assistant Examiner*—Carmine Cuda
*Attorney, Agent, or Firm*—Haugen and Nikolai

[57] ABSTRACT

The present invention relates to an improved synthetic resinous formulation utilized to form a substrate for retention of carpet while securing tack and pre-nail elements in strip form, and with the pre-nails being adapted to secure the substrate in place along the edge surfaces of the floor and with the tack elements being adapted to retain the edge portions of a carpet in place thereon. The substrate is characterized in that it is formed essentially of a filled polyurethane compound which possesses unusual mechanical properties particularly desirable in the formation of carpet retaining strips. These properties include the flexibility to permit the strip to conform to an irregular floor surface, and furthermore can be readily cut and notched to allow it to be bent to conform to an inside or outside corner. Because of the excellent plastic memory, the carpet retaining tacks are held at a desired angle even when subjected to substantial lateral tension caused by the stretched in-place carpet. The formulation of the polyurethane includes a prepolymer comprising a polyether polyol (35%–40%), a cross-linking agent (15%–20%), a filler consisting essentially of inert ingredients (10%–36%), a catalyst (10%–15) and a chemical blowing or frothing agent (mechanical) (3%–5%), and wherein methylene di-isocyanate is added to the prepolymer components blend (component B), the prepolymer consisting of 80% of the blend, balance methylene di-isocyanate (component A) (20%).

8 Claims, 1 Drawing Sheet

CARPET TACK STRIP WITH URETHANE BASE

BACKGROUND OF THE INVENTION

The present invention relates generally to an improved system for anchoring carpeting to the floor, and more particularly to an improved carpet tack strip whose base or substrate is formed from a synthetic resinous formulation capable of being penetrated by tack elements and pre-nail elements, with those elements being tightly lodged and retained in the strip.

Carpet securing elements, commonly called "tack strip" has long been used to retain the edge portions of floor carpeting in place. In accordance with the prior art, this tack strip comprises a plywood base, typically four feet in length and one inch wide, which is passed through a nailing machine used to insert a large plurality of nails or tacks through the thickness dimension of the strip so that they project from the upper surface thereof at a predetermined angle. The strip may also be provided with pre-nails which are nail elements also inserted through the plywood base but intended to be hammered down so as to fasten the tack strip to a wooden or concrete floor surface.

Typically, the substrates used to retain the tacks and pre-nails in place are produced from large plywood sheets which are cut into strips. This process tends to be quite wasteful with approximately four percent of a plywood sheet being converted to sawdust and scrap as the saw blades pass through to create the strips of a desired width. Moreover, when subjected to the nailing process, the plywood strips will frequently splinter, resulting in further rejects and waste. When splintering occurs as the strips are being fed through the tack inserting machinery, it becomes necessary to shut down the production while the jam is cleared. This, too, increases the manufacturing cost beyond that which it should be.

The prior art tack strips with plywood base creates still further problems during the carpet installation process. First of all, the plywood substrates are rigid and cannot be formed around corners. This requires frequent cutting of the strips as the worker progresses around the perimeter of the room. Because of the inconsistencies and irregularities in the plywood material, the retaining force afforded to the tacks is inconsistent and when the carpet is stretched and forced onto the tacks, they sometimes are loosened to the point where they can swivel and no longer serve to provide an adequate anchoring force. Plywood tack strips can only be used once and cannot be removed and reused because the removal process destroys the substrate.

Still another problem associated with the prior art plywood substrate tack strip comes into play when such tack strip is adhesively bonded rather than nailed to, say, a concrete floor prior to carpeting. It can happen due to manufacturing irregularities in the fabrication of the plywood from which the strips are cut that discontinuities exist between lamination. When the pulling force of the stretched carpet is applied, the wood layers delaminate requiring removal and replacement.

SUMMARY OF THE INVENTION

In accordance with the present invention, an improved synthetic resinous formulation is provided from which the substrate means of the carpet securing elements may be fabricated in a pour molding or extrusion molding process. In this connection, the formulation for the synthetic resinous material is that of a filled polyurethane substance having a density of between about 30 pounds per cubic foot and 65 pounds per cubic foot. Such a density is achieved when pulverized inert ingredients are employed as the filler in an amount ranging from a minimum of about 10% t o a maximum of 36%. The material is in the form of a dispersion or liquid, and consists essentially of polyurethane comprising the reaction product of a polyisocyanate and a polyol consisting of a linear polyether with plural hydroxyl groups thereon. This material is reacted, in the presence of a catalyst, with methylene di-isocyanate. While formulations similar to the above have been known in the past, the present invention relates to the application of this material as a substrate means for retention of carpet securing tack and pre-nail elements in strip form.

As indicated hereinabove, plywood strips have traditionally and typically been employed as the substrate material. The present polyurethane substrate material provides significant advantages over plywood. For example, the resistant nature of polyurethanes to either rot or mildew is advantageous in marine applications, and furthermore the polyurethane is not subject to attack or deterioration by termites. When the strips are formed in a pour molding operation, shipping and handling costs are much lower than when plywood is employed. The chemicals can be shipped in bulk to the place of manufacture and then mixed at the time of manufacture. Thus, the volume of the shipped material is much less than the volume of plywood for producing an equivalent number of strips of equal length.

Polyurethane strips made in accordance with the present invention can readily be cut with a snip-tool, a feature not possible with plywood as employed in the past inasmuch as the plywood product is difficult to cut and/or sever without creating splintering along the body of the substrate. The urethane product may be readily bent to conform to an irregular floor surface, and furthermore may be notched in order to allow it to be bent to conform readily to an inside or outside corner. Such notching is an advantage possessed by the material in addition to the ease by which it may be cut.

Also, as has been indicated, the polyurethane strip, due to its excellent plastic memory, tends to hold the individual tacks at their desired angle relative to the substrate surface, even when subjected to substantial forces caused by lateral tension in the stretched and retained carpet.

OBJECTS

Therefore, it is a primary object of the present invention to provide an improved substrate material for use as a retainer of carpet retaining tacks and pre-nail elements.

It is a further object of the present invention to provide an improved substrate for retention of carpet securing tack and pre-nail elements in strip form, and wherein the substrate is fabricated from a synthetic resinous formulation consisting essentially of an inert ingredient of particle filled polyurethane dispersion.

Still another object of the invention is to provide a synthetic material to be used as a tact strip substrate which can be removed and reused without destroying the strip material.

Yet another object of the invention is to provide a tack strip having a synthetic resinous formulation consisting essentially of inert ingredient particle filled polyurethane dispersion as its substrate and which can be produced in continuous lengths and which can be passed through a tacking machine on a continuous basis rather than as individual pieces of precut length.

Other and further objects of the present invention will become apparent to those skilled in the art upon a study of the following specification, appended claims, and accompanying drawings.

DETAILED DESCRIPTION OF THE PREFERRED EMBODIMENT

Figure 1:
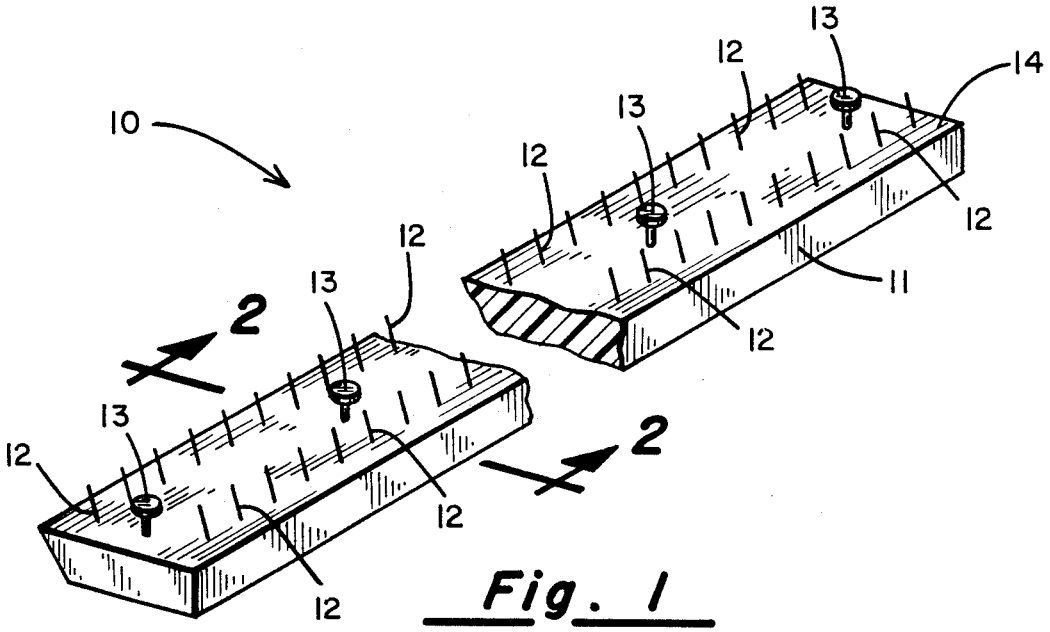
FIG. 1 is a perspective view of a length of carpet retaining strip fabricated in accordance with the present invention.
Figure 2:
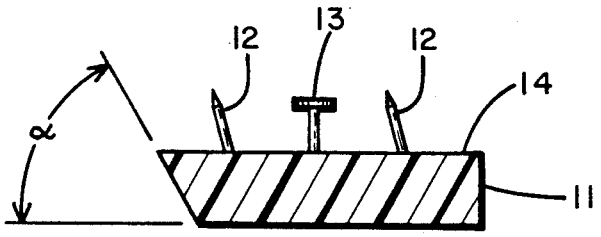
FIG. 2 is a vertical sectional view taken along the line and in the direction of the arrows 2—2 of FIG. 1.

In accordance with the present invention, the carpet retaining strip generally designated 10 includes a substrate body or means 11 into which there has been inserted a plurality of carpet securing tack elements 12—12 along with pre-nail elements 13—13. As indicated, the substrate means 11 is arranged in elongated strip form, and possesses a cross-sectional profile of the form as indicated in FIG. 2. The strip 11 is preferably approximately 5/16ths inch thick and ¾ths - 1 inch in width. The pins 12 are driven through the thickness dimension of the substrate 11 and project outwardly from the top surface 14 thereof at an angle of approximately 22°. The pins are spaced along first and second rows in a staggered relationship approximately 1½ inches apart, the rows being approximately ¼th inch from one another. While in FIG. 1, only two rows of pins are indicated, conventional tack strip may also be constructed using three rows of pins. The prenails 13 are conveniently spaced at 6 inch intervals along the length dimension of the tack strip and approximately halfway across the width dimension thereof.

With attention being directed to FIG. 2, it will be seen that the cross-sectional profile includes a recessed area or zone defined by the angle $\alpha$. The angle $\alpha$ preferably is in the range of between about 15° and 25°, and is designed to permit tucking of the carpet edge under the edge of the strip. Again, such angular cross-section profiles have been known and utilized in connection with carpet securing strips in the past. With plywood substrates of the prior art, however, the angle tended to be quite small so as to eliminate undue waste during the cutting operation. With the material of the present invention being molded or extruded, there is no waste and the angle can be set to afford proper holding of the carpet.

As indicated hereinabove, the substrate 11 consists of a formulation consisting essentially of a frothed or chemically blown polyurethane. In order to better comprehend the nature of this formulation, the following example is given for its preparation.

EXAMPLE A

| Component | Percent by Weight |
|---|---|
| Polyol, a linear polyether with plural hydroxyl groups | 35%–40% |
| Cross-linking agent consisting essentially of methylene di-isocyanate | 15%–20% |
| Reinforcing filler, or inert ingredients with an average particle size of between 0.5 microns and 35.0 microns | 10%–36% |
| Catalyst (typically amines, tin soaps, organic tin compounds) | 10%–15% |
| Chemical blowing agents or frothing agents (mechanical) | 3%–5% |

The above formulation is normally prepared as a prepolymer, and when formed, is blended with a second component consisting essentially of methylene di-isocyanate. The prepolymer and methylene di-isocyanate are mixed on a basis of 80 percent to 20 percent, respectively.

For flexibility, flexible polyurethane are normally based on polyoxypropylene-diols with a molecular weight of about two thousand, and triols with molecular weights up to about four thousand. Such polyurethane are, of course, known and commercially available.

In forming the blend of materials, the constituents making up the prepolymer are initially placed within a large vat and, using a pump blending system, these components, together with the added methylene di-isocyanate, are thoroughly blended until homogenous, and thereafter, immediately introduced into an extruder, a pour mold, a rotary mold or a vacuum mold. In the manufacture, the cross-linking temperature is maintained between about 260° F. and 300° F., it being noted that the urethane compound being produced and described above undergoes cross-linking at about 280° F. A conventional blowing agent or frothing agent is employed which, under these environmental conditions, becomes volatile and fugitive, and forms the appropriate cellular product with the density indicated. Blowing agents and frothing agents compatible with polyurethanes and capable of activation at the temperatures indicated are, of course, commercially available.

By way of a specific formulation, the prepolymer (component A) is formulated as follows:

EXAMPLE B

| | Percent by Weight |
|---|---|
| Component A | |
| Cross-linking agent consisting essentially of methylene di-isocyanate | 15–20 |
| Component B | |
| Polyol, a linear polyether with plural hydroxyl groups | 35–40 |
| Reinforcing filler, inert ingredients an average particle size of between 0.5 microns and 35 microns | 10–36 |
| Catalyst (typically amines, tin soaps, organic tin compounds) | 10–15 |
| Chemical blowing or frothing agents (mechanical) | 3–5 |

It can be seen, then, that in accordance with the present invention there is provided a tack strip substrate material which can readily be cut into appropriate size pieces during the carpet installation process without decreasing the overall strength or structure. Unlike wood, the substrate is impervious to moisture and thus can be used for marine applications in both fresh and salt water. Moreover, being moldable or extrudable, the tack strip substrate can be produced without any significant waste and with a minimum of manual labor involved. This greatly reduces the overall manufacturing cost of the product as compared to the prior art.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A carpet tack strip for securing carpet in place on a floor of interest including a synthetic resinous strip means adapted to carry tack and pre-nail elements with the tack elements being adapted to retain the edge portions of a carpet in place thereon, said tack strip further comprising:

a synthetic resinous formulation consisting essentially of an at least partially filled, cross-linked relatively low density polyurethane material comprising the reaction product of a polyol prepolymer and an isocyanate cross-linking agent, wherein said polyol is selected from the group consisting of polyoxypropylene-diols having a molecular weight up to approximately 2000 and polyoxypropylene-triols having a molecular weight up to approximately 4000, wherein said polyisocyanate consists essentially of methylene di-isocyanate;

an amount of a catalyst;

an amount of reinforcing a filler consisting essentially of inert particles with an average particle diameter of between about 0.5 microns and 35.0 microns;

a porosity inducing agent selected from chemical blowing agents and mechanical frothing agents activated at temperatures in excess of about 260° F. to produce a cellular structure;

a plurality of spaced carpet securing tack elements received in and protruding from the top of said strip; and means for fastening the strip to said floor of interest.

2. The carpet tack strip of claim 1 wherein said means for fastening the strip to the floor of interest comprises a plurality of pre-nails spaced along said tacks trip, said pre-nails being inserted from the top and projecting outward through the bottom of the strip.

3. The carpet tack strip of claim 1 wherein said plurality of carpet securing tack elements are arranged in a plurality of rows in parallel spaced relation along said strip.

4. The carpet tack strip of claim 1 wherein the tack strip material has a density between about 30 pounds per cubic foot and 65 pounds per cubic foot.

5. The carpet tacks trip of claim 1 wherein said synthetic resinous formulation further comprises:

from about 35% to about 40% polyol;

from about 15% to about 20% cross-linking agent consisting essentially of methylene di-isocyanate;

from about 10% to about 36% reinforcing filler material;

from about 10% to about 15% catalyst; and from about 3% to about 5% porosity inducing agent selected from chemical blowing agents and mechanical frothing agents.

6. The carpet tack strip of claim 5 wherein the synthetic resinous strip means has a density between about 30 pounds per cubic foot and 65 pounds per cubic foot.

7. The carpet tack strip of claim 5 wherein the tack strip material has a density between about 30 pounds per cubic foot and 65 pounds per cubic foot.

8. The carpet tack strip of claim 5 wherein said plurality of carpet securing tack elements are arranged in a plurality of rows in parallel spaced relation along said strip.

* * * * *

UNITED STATES PATENT AND TRADEMARK OFFICE

CERTIFICATE OF CORRECTION

PATENT NO. : 4,970,754

DATED : November 20, 1990

INVENTOR(S) : Martin L. Anderson and Benny R. Wood

It is certified that error appears in the above-identified patent and that said Letters Patent is hereby corrected as shown below:

Column 5, line 45, after "reinforcing" insert a semicolon -- ; --.

Column 6, line 15, delete "tacks trip," and put instead -- tack strip, --.

Column 6, line 24, delete "tacks trip" and put instead -- tack strip --.

Signed and Sealed this

Third Day of March, 1992

*Attest:*

HARRY F. MANBECK, JR.

*Attesting Officer*

*Commissioner of Patents and Trademarks*